US007278629B2

(12) United States Patent
Nonaka

(10) Patent No.: US 7,278,629 B2
(45) Date of Patent: Oct. 9, 2007

(54) CARBURETOR

(75) Inventor: Takumi Nonaka, Iwate-ken (JP)

(73) Assignee: Zama Japan (JP)

( * ) Notice: Subject to any disclaimer, the term of this patent is extended or adjusted under 35 U.S.C. 154(b) by 206 days.

(21) Appl. No.: 10/900,540

(22) Filed: Jul. 27, 2004

(65) Prior Publication Data

US 2005/0035471 A1 Feb. 17, 2005

(30) Foreign Application Priority Data

Aug. 11, 2003 (JP) ..... 2003-291158

(51) Int. Cl.
*F02M 7/06* (2006.01)

(52) U.S. Cl. ..... 261/50.1; 261/50.2; 261/51

(58) Field of Classification Search ..... 261/51, 261/50.1, DIG. 50, 50.2
See application file for complete search history.

(56) References Cited

U.S. PATENT DOCUMENTS

| | | | | | |
|---|---|---|---|---|---|
| 2,552,056 | A * | 5/1951 | Orr, Jr. | 261/39.2 |
| 2,905,455 | A * | 9/1959 | Eberhardt | 261/36.2 |
| 3,023,744 | A * | 3/1962 | Mick | 261/50.2 |
| 3,387,831 | A * | 6/1968 | Brown et al. | 261/51 |
| 3,618,904 | A * | 11/1971 | Woods | 261/103 |
| 3,680,846 | A * | 8/1972 | Bickhaus et al. | 261/51 |
| 4,000,224 | A * | 12/1976 | Phelps | 261/36.2 |
| 4,347,195 | A * | 8/1982 | Ogawa | 261/18.3 |
| 4,861,522 | A * | 8/1989 | Gerhardy et al. | 261/35 |
| 5,250,233 | A * | 10/1993 | Swanson | 261/34.2 |
| 5,411,680 | A * | 5/1995 | McCarthy et al. | 261/35 |
| 5,554,322 | A * | 9/1996 | Kobayashi | 261/35 |
| 6,394,426 | B1 * | 5/2002 | Galka et al. | 261/49 |
| 2003/0168752 | A1 * | 9/2003 | Nonaka | 261/35 |
| 2003/0173686 | A1 * | 9/2003 | Nonaka | 261/51 |
| 2004/0070089 | A1 * | 4/2004 | Blixt | 261/44.4 |

FOREIGN PATENT DOCUMENTS

| | | | |
|---|---|---|---|
| DE | 3109875 | * 11/1982 | 261/51 |
| JP | 47-38218 | 12/1972 | |
| JP | 55-069748 | 5/1980 | |

* cited by examiner

*Primary Examiner*—Richard L. Chiesa
(74) *Attorney, Agent, or Firm*—Orrick, Herrington & Sutcliffe LLP

(57) ABSTRACT

A flow rate control mechanism is provided to a low-speed fuel system that is independent from the main fuel system of a carburetor. The mechanism causes the valve element to move in a linear fashion by means of a cam coupled to the throttle stem. The mechanism increases the effective cross-sectional area of the low-speed fuel channel as the throttle valve opens from the idle position to the maximum degree of opening until the point in time at which the main fuel begins to flow, and thereafter causes the low-speed fuel flow rate to decrease and become zero in the high-output region. The transition from low-speed fuel to main fuel is made smooth, ensuring higher output and a stable fuel flow rate in the high-output region.

15 Claims, 3 Drawing Sheets

CARBURETOR

FIELD OF THE INVENTION

The present invention relates to a carburetor for supplying fuel to an engine, and more particularly to a type of carburetor that has a mechanism for smoothing the transition from low-output operation to mid- and high-speed operation.

BACKGROUND OF THE INVENTION

In carburetors for automobile engines having a main system for delivering main fuel to the venturi area of an air intake passage that passes through the carburetor main body, and a low-speed system for delivering low-speed fuel to the throttle valve area, the low-speed system is typically branched from the main system. In contrast, in carburetors for general-purpose engines, see e.g. Japanese Patent Application Laid-open No. 47-38218 and Japanese Patent Application Laid-open No. 55-69748, the two systems are separated and the low-speed system is made independent with respect to the main system; the advantages of which are the main fuel begins to flow early, and there is no back bleed phenomena in the low-speed system.

However, in carburetors for general-purpose engines, a small amount of fuel is handled in comparison with carburetors for automobile engines. As a result, the fuel flow rate that affects the engine performance or exhaust gas must be precisely adjusted. It is for this reason that in addition to providing a main jet for restricting the maximum fuel flow rate of the main fuel and a low-speed jet for restricting the maximum fuel flow rate of the low-speed fuel, an adjustment screw with a needle valve, such as that cited in the above-mentioned publications, is provided to allow the main fuel flow rate and the low-speed fuel flow rate to be separately adjusted.

In other words, the variability in the fuel flow rate fed to the engine is the combined variability in the dimensions of the main jet and the low-speed jet. The deviation in the fuel flow rate due to variability in these dimensions, and the difference in the required fuel flow rate due to variability in individual engines are corrected using an adjustment screw.

However, the fuel flow rate restriction and adjustment devices, such as those described above, separately restrict or correct the flow rate of fuel that flows respectively through the main system and the low-speed system. The disadvantages for the above-described conventional carburetors having such devices are that when the venturi diameter is increased in order to ensure high output, the time at which the main fuel begins to flow is delayed even in a type in which the low-speed system is made independent from the main system, a temporary fuel flow rate deficiency is also created because the low-speed fuel flow rate is limited to a set rate or less, and the transition from low-output operation to mid- or high-output operation cannot be carried out smoothly.

SUMMARY OF THE INVENTION

The present invention was developed with the aim of solving the above-stated problems in which the transition from low-output operation to mid- or high-output operation cannot be carried out smoothly when the venturi diameter is increased in an attempt to achieve higher output in the above-described conventional carburetors having a restricting device and a correcting device for the flow rate of fuel that flows respectively through the main system and the low-speed system. A primary object of the present invention is to enable a smooth transition from low-output operation to mid- or high-output operation, as well as easy compliance with exhaust gas restrictions.

In order to solve the above-described problems in a carburetor having a main system for delivering main fuel to the venturi area of an air intake passage that passes through the carburetor main body, and a low-speed system for delivering low-speed fuel to the throttle valve area, the present invention provides the low-speed fuel system with a flow rate control mechanism that is linked to the throttle valve and is capable of varying the low-speed fuel flow rate. The flow rate control mechanism operates so as to cause the low-speed fuel flow rate to increase as the throttle valve opens from the idle position to its maximum degree of opening until the point in time at which the main fuel begins to flow, and thereafter to cause the low-speed fuel flow rate to decrease and become substantially zero in the high-output region.

The object of the present invention is thereby achieved in that the transition to the main fuel is improved without generating a fuel flow rate deficiency due to the increase of the low-speed fuel flow rate up to the point of transition. Furthermore, the transition from low-output operation to mid- or high-output operation is performed smoothly, even if the time at which the main fuel begins to flow is delayed by increasing the venturi diameter to ensure higher output. There is also an advantage in that solely main fuel is substantially or entirely delivered during high output. As a result, the variability in the fuel flow rate fed to the engine is caused solely by the variability in the main jet of the main system, unevenness in the fuel flow rate in the high-output region decreases, and compliance with exhaust gas restrictions is facilitated.

The fuel flow rate control mechanism in the present invention preferably has a valve element for varying the effective cross-sectional area of the low-speed fuel channel, a cam coupled to the throttle valve stem, and a driven member that holds a valve stem, remains in constant contact with the cam, and reciprocates linearly. The valve element varies the effective cross-sectional area of the low-speed fuel channel in association with the opening and closing action of the throttle valve. Another feature of this fuel flow rate control mechanism is that if the attachment position to the driven member of the valve element is made adjustable, then the low-speed fuel flow rate can be appropriately adjusted in accordance with the variability of the period in which main fuel begins to flow and the variability of the fuel channel machining. Furthermore, the acceleration fuel required during a rapid opening action of the throttle valve can be fed by adopting an arrangement in which the low-speed fuel is forced out toward the air intake channel when the valve element operates in the direction that reduces the effective cross-sectional area of the low-speed fuel channel.

In accordance with the present invention, the delay in the time at which main fuel begins to flow, resulting from increasing the venturi diameter to achieve higher output, can be compensated for by increasing the low-speed fuel flow rate, and the transition from low-output operation to mid- or high-output operation can be carried out smoothly. Also, compliance with exhaust gas restrictions is facilitated by the variability in the fuel flow rate due to the main system alone in which main fuel is substantially solely delivered in the high-output region.

Other objects and features of the present invention will become apparent from consideration of the following description taken in conjunction with the accompanying drawings.

DESCRIPTION OF THE PREFERRED EMBODIMENTS

Figure 1:
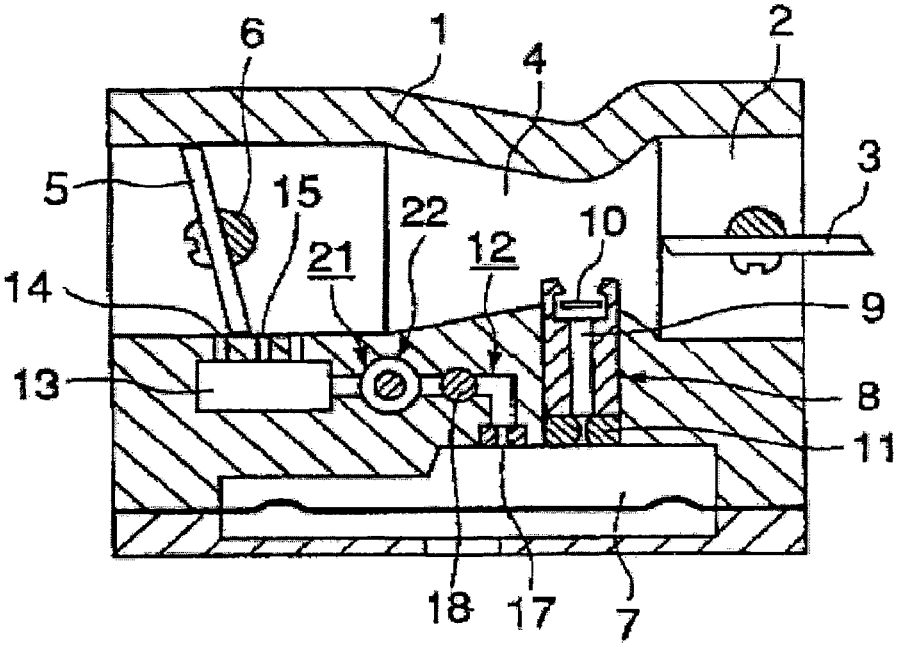
FIG. 1 is a longitudinal sectional layout diagram showing an embodiment of the present invention.
Figure 2:
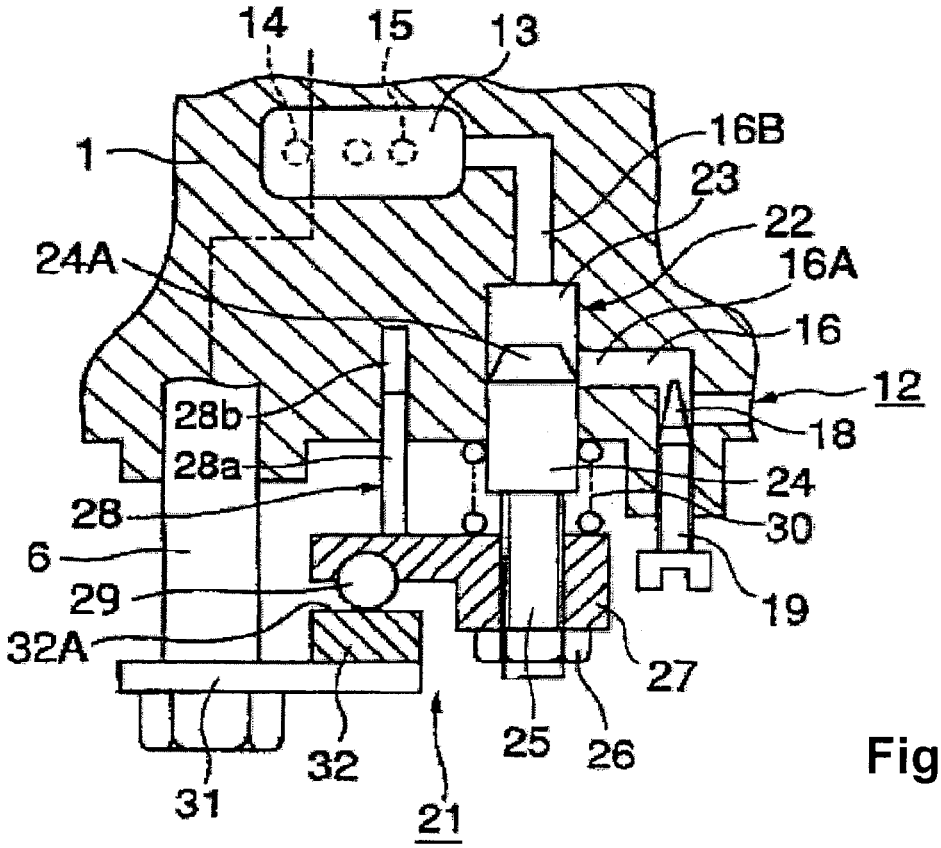
FIG. 2 is an enlarged partial cross-sectional diagram of FIG. 1.

The embodiments of the present invention are described below with reference to the diagrams. As shown in FIGS. 1 and 2, an air intake channel 2 that is formed completely through the carburetor main body 1 and extends in the lateral direction has, in order from the inlet to the outlet, a choke valve 3, a venturi 4, and a throttle valve 5. A constant fuel chamber 7, which may be a float type or a diaphragm type and which is a diaphragm type in this embodiment, is disposed in the lower portion of the carburetor main body 1.

A main nozzle 9 doubling as the main fuel channel opens into the narrowest portion of the venturi 4. A check valve 10 that prevents the air in the air intake channel 2 from flowing into the constant fuel chamber 7 is disposed at the outlet of the main nozzle 9. A main jet 11 that restricts the maximum flow rate of the main fuel is disposed in the inlet of the main nozzle 9, facing the constant fuel chamber 7. The main nozzle 9, check valve 10, and main jet 11 constitute the main fuel system 8. An adjustment screw (not shown) with a needle valve for adjusting the main fuel flow rate is provided in the present embodiment.

An idle port 14 and a part-throttle port 15 connected to a cluster chamber 13 open to a region on the throttle valve 5 side of the air intake channel 2. The constant fuel chamber 7 and the cluster chamber 13 are connected by way of a low-speed fuel channel 16. The low-speed fuel channel 16 contains, in order from the inlet, a low-speed jet 17 for restricting the maximum fuel flow rate of the low-speed fuel, an adjustment screw 19 with a needle valve 18 for adjusting the low-speed fuel flow rate, and the on-off valve 22 of a flow rate control mechanism 21 described below. The cluster chamber 13, the ports 14 and 15, the low-speed fuel channel 16, the low-speed jet 17, and the adjustment screw 19 constitute a low-speed system 12. The low-speed jet 17, however, may be dispensed with.

In the on-off valve 22, a cylindrical valve element 24 with a truncated conical tip having a sloped face 24A is fitted into a cylindrical valve chamber 23. The inlet 16A to the valve chamber 23 in the portion extending from the constant fuel chamber 7 of the low-speed fuel channel 16 opens to the peripheral lateral surface of the valve chamber 23. The outlet 16B from the valve chamber 23 in the portion leading to the cluster chamber 13 opens to the end face of the valve chamber 23. A screw stem 25 protrudes from the base end of the valve element 24. The screw stem 25 is threadably mounted in the driven member 27 and is fixed at a required threaded position by a locknut 26. A rod member 28 protrudes from the surface of the driven member 27 that faces the main carburetor body 1. The rod member 28 has a rotation stop 28*a* fitted into a receiving hole 28*b* provided to the carburetor main body 1. A contact member 29 composed of a ball is rotatably mounted on the opposite surface of the driven member 27. In addition, a push spring 30 comprised of a compression coil is fitted between the driven member 27 and the carburetor body 1.

Figure 4:
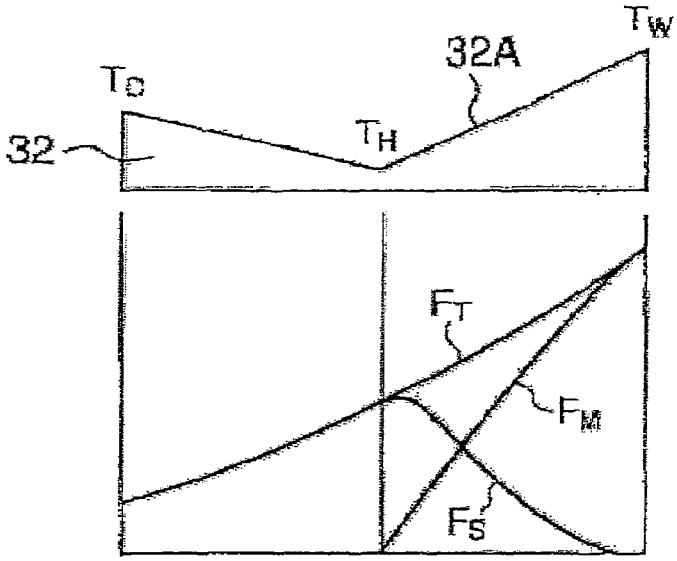
FIG. 4 is a diagram describing the relationship between the cam and the fuel flow rate in the embodiment of FIG. 1.

A cam member 31 is affixed to the axle end of the throttle valve stem 6. A circular cam 32 with the throttle valve stem 6 as the center is formed protruding from the surface of the cam member 31 that faces the main carburetor body 1. The contact member 29 is caused by the push spring 30 to be in constant contact with the cam face 32A. With reference to FIG. 4, the cam face 32A is formed to gradually drop down, as the degree of opening of the throttle valve 5 increases, from a height at which the contact member 29 is in contact at the idle position $T_c$ of the throttle valve 5. The height of the cam face 32A is at its lowest when the contact member 29 is in contact at the half-open position $T_H$ of the throttle valve 5 in the area in which main fuel begins to flow, and then gradually rises until arriving at the fully open position $T_W$ of the throttle valve 5. The on-off valve 22, driven member 27, rotation stop 28*a*, push spring 30, and cam 32 described above comprise the fuel flow rate control mechanism 21.

Figure 3A:
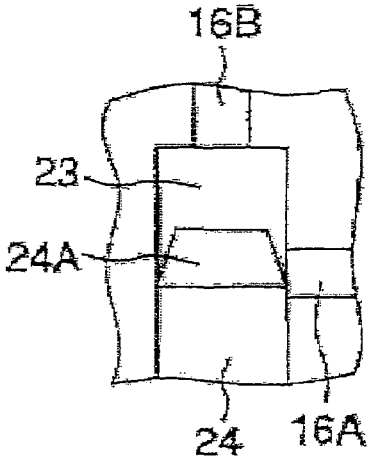
FIG. 3A is an operation diagram of a fuel flow rate control mechanism shown in the embodiment of FIG. 1 during engine idling.

During engine idling, the driven member 27 is caused by the cam face 32A to be positioned so that the valve element 24 positions its sloped surface 24A in front of the inlet 16A to limit the flow rate of the low-speed fuel flowing into the valve chamber 23, as shown in FIG. 3(A). At this time, the effective cross-sectional area of the low-speed fuel channel 16 that is constricted by the valve element 24 at the inlet 16A ensures the fuel flow rate required for idling, which includes engine low temperature start-up and warm-up operation. However, the magnitude of the flow is such that an excessive amount is not delivered.

Figure 3B:
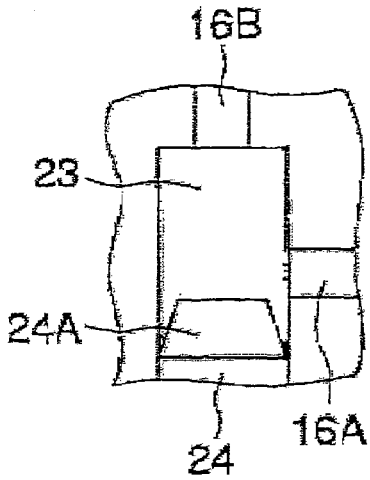
FIG. 3B is an operation diagram of a fuel flow rate control mechanism shown in the embodiment of FIG. 1 as the throttle valve increases the degree of opening from the idle position and the main fuel begins to flow.

When the throttle valve 5 increases the degree of opening from the idle position, the valve element 24 gradually retracts from the area in front of the inlet 16A as the height of the cam surface 32A in contact with the contact member 29 gradually decreases. When the main fuel begins to flow or at a time slightly thereafter, the sloped surface 24A completely withdraws from the area in front of the inlet 16A to open the entire low-speed fuel channel 16, as shown in FIG. 3(B). The rate at which the fuel flows through the low-speed fuel channel 16 is thereby increased in accordance with fuel flow rate required by the engine, which increases when the throttle valve 5 is opened from the idling position, without generating a temporary fuel flow rate deficiency until the main fuel is delivered.

Figure 3C:
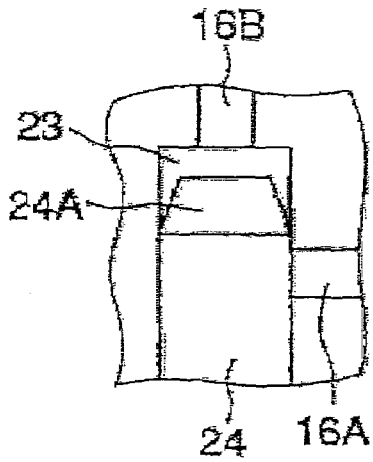
FIG. 3C is an operation diagram of a fuel flow rate control mechanism shown in the embodiment of FIG. 1 as the fully open position of the throttle valve is reached.

In the interval of time that the throttle valve 5 is opened from the half-open position $T_H$ to the fully open position $T_W$, the valve element 24 is once again gradually advanced into the area in front of the inlet 16A by the gradual increase of the height of the cam surface 32A in contact with the contact member 29. The inlet 16A is completely closed, or the inlet 16A is gradually narrowed to a greater extent, when or slightly before the fully open position $T_W$ of the throttle valve 5 is reached, as shown in FIG. 3(C). The low-speed fuel flow rate decreases in accordance with the increase of the main fuel flow rate, and the main fuel alone is fed to the engine in the high-output region. FIG. 4 shows variations in the main fuel flow rate $F_M$ and the low-speed fuel flow rate $F_S$ in the interval of time in which the throttle valve 5 is opened from the idle position $T_C$ to the fully open position $T_W$, as well as variations in the total fuel flow rate $F_T$ as the combined flow rate thereof, corresponding to the cam surface 32A. It is apparent from FIG. 4 that a smooth transition can be made from low-output operation to mid- or high-output operation without temporarily creating a fuel flow rate deficiency.

In the present embodiment, the driven member 27 pressed towards the cam member 32 by the push spring 30 causes the valve element 24 to reciprocate in a linear fashion in accordance with the change in height of the cam 32. The valve element 24 is prevented from rotating due to the rotational force of the throttle valve stem 6 by the action of the rotation stop 28. The low-speed fuel flow rate can be precisely controlled as a result. Also, the mounting position of the valve element 24 on the driven member 27, in other words, the positional relationship with the inlet 16A in the idle position $T_C$ or the half-open position $T_H$, can be adjusted by changing the threaded position of the screw stem 25, whereby the low-speed fuel flow rate can be adjusted so as to achieve a proper flow rate in accordance with the variability of the period in which main fuel begins to flow and variability in the machining of the low-speed fuel channel 16. Alternately, the position of the valve element 24 at the half open position $T_H$ at which the valve element 24 is retracted to the fullest amount, can be adjusted to maximize the effective cross-sectional area of the low-speed fuel channel 16. Therefore, it is apparent that the inlet 16A and the valve element 24 constitute a variable low-speed jet because the valve element functions as a low-speed jet that restricts the maximum fuel flow rate, and the jet diameter varies in accordance with the degree of opening of the throttle valve 5.

Furthermore, in the present embodiment, the valve element 24 operates to force the low-speed fuel in the valve chamber 23 from the position in front of the outlet 16B to the cluster chamber 13 when the throttle valve 5 rapidly opens from the half open position $T_H$ to the fully open position $T_W$, and feed the low-speed fuel as acceleration fuel.

Figure 5:
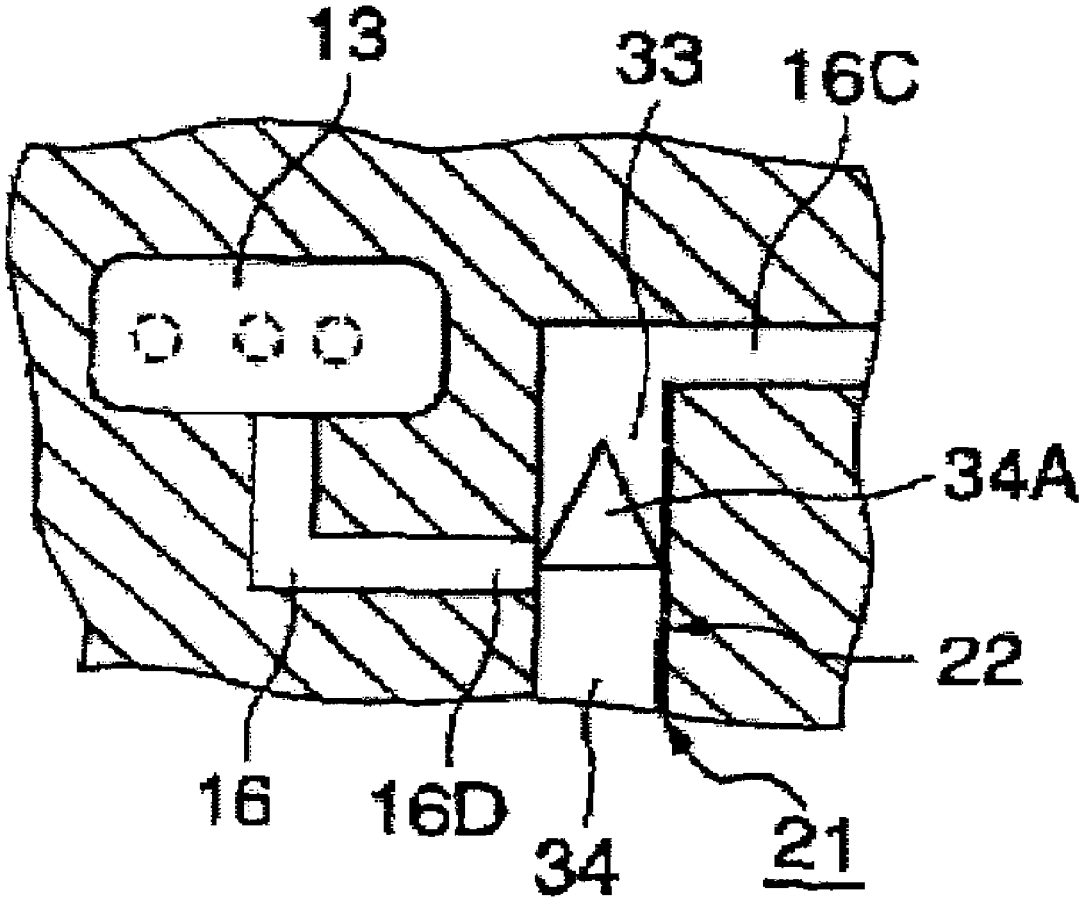
FIG. 5 is a partial cross-sectional diagram showing another embodiment of the present invention.

FIG. 5 shows an embodiment in which the effective cross-sectional area of the low-speed fuel channel 16 is merely varied without providing an acceleration pump function to the on-off valve 22 of the flow rate control mechanism 21. In the present embodiment, the valve element 34 of the on-off valve 22 is in the shape of a round rod whose tip is conical with a sloped face 34A, and is fitted into a cylindrical valve chamber 33. The inlet 16C to the valve chamber 33 in the portion extending from the constant fuel chamber of the low-speed fuel channel 16 opens in the vicinity of the end face of the valve chamber 33 in front of the valve element 34, and the outlet 16D from the valve chamber 33 in the portion leading to the cluster chamber 13 opens to the peripheral lateral surface of the valve chamber 33. In the same manner as in the previous embodiment, the valve element 34 is fixed to the driven member 27 in an adjustable mounting position that is moved in a linear fashion by a cam coupled to the throttle valve stem.

The sloped face 34A, positioned in front of the outlet 16D in the idle position of the throttle valve, limits the flow rate of low-speed fuel that flows from the valve chamber 33. The sloped face 34A gradually retracts from the area in front of the inlet 16D as the degree of opening of the throttle valve increases. Once the low-speed fuel channel 16 is completely open, the valve element 34 advances to gradually narrow the outlet 16D a considerable degree. The outlet 16D is completely closed at the fully open position of the throttle valve. The low-speed fuel flow rate is thereby increased up to the time at which the main fuel begins to flow as the degree of opening of the throttle valve increases from the idle position, and thereafter the low-speed fuel flow rate decreases and becomes zero in the high-output region.

In the two embodiments described above, the flow rate control mechanism 21 brings the low-speed fuel flow rate to zero at the fully open position of the throttle valve, or slightly prior thereto, in other words, in the high-output region, and the main fuel alone is then fed to the engine. For this reason, even if the venturi diameter is increased for higher output, the entire amount of fuel in the air intake passage can be delivered to the venturi area in which the airflow velocity is at its maximum, atomization can be uniformly carried out, and combustibility in the engine can be improved. Also, in order to provide the fuel flow rate required by the engine in the high-output region with solely main fuel, the jet shape of the main jet 11 shown in FIG. 1 is given a larger size than normal. Further, a carburetor with a choke valve 3, as in FIG. 1, is advantageous in that a large quantity of start-up fuel can be delivered from the main nozzle 9 during low-temperature start-up in which the choke valve 3 is closed, thus improving the low temperature start-up characteristics.

Furthermore, in the two above-described embodiments, the cause of variability in the fuel flow rate in the high-output region in which the main fuel alone is delivered is limited to the variability in the main system. The advantage being that not only is deviation in the fuel flow rate reduced and compliance with exhaust gas restrictions facilitated, but the fuel flow rate remains stable at high output irrespective of the manner in which the low-speed fuel flow rate is adjusted—whether using the flow rate control mechanism 21 or the adjustment screw 19 shown in FIG. 2—to handle engine variability, fuel differences, temperature and pressure changes, and other factors. The object of the present invention is not compromised if the sloped faces 24A and 34A slightly narrow the inlet 16A or the outlet 16D without fully opening the low-speed fuel channel 16 at the time that the main fuel begins to flow, or if the inlet 16A or the outlet 16D is not fully closed but is slightly open at the fully open position of the throttle valve.

While the invention is susceptible to various modifications and alternative forms, a specific example thereof has been shown in the drawings and is herein described in detail. It should be understood, however, that the invention is not to be limited to the particular form disclosed, but to the contrary, the invention is to cover all modifications, equivalents, and alternatives falling within the spirit of the claims appended hereto.

What is claimed is:

1. A carburetor having a main system for delivering main fuel to the venturi area of an air intake passage that passes through the carburetor main body, and a low-speed system for delivering low-speed fuel to the throttle valve area, wherein the low-speed fuel system comprises a flow rate control mechanism that is linked to a throttle valve and is capable of varying the low-speed fuel flow rate, and the flow rate control mechanism causes the low-speed fuel flow rate to increase as the throttle valve opens from the idle position until the point in time at which the main fuel begins to flow, and thereafter causes the low-speed fuel flow rate to decrease as the throttle opens to the maximum degree of opening and become substantially zero in the high-output region, wherein the flow rate control mechanism includes an on-off valve for opening and closing a low-speed fuel channel in the low-speed fuel system, wherein a valve element of the on-off valve increases the degree of opening of the on-off valve as the throttle valve opens from the idle position until the point in time at which the main fuel begins to flow, and thereafter decreases the degree of opening of the on-off valve as the throttle opens to the maximum degree of opening and until the on-off valve is substantially closed in the high-output region.

2. A carburetor having a main system for delivering main fuel to the venturi area of an air intake passage that passes through the carburetor main body, and a low-speed system for delivering low-speed fuel to the throttle valve area, wherein the low-speed fuel system comprises a flow rate control mechanism that is linked to a throttle valve and is capable of varying the low-speed fuel flow rate, and the flow rate control mechanism causes the low-speed fuel flow rate to increase as the throttle valve opens from the idle position until the point in time at which the main fuel begins to flow, and thereafter causes the low-speed fuel flow rate to decrease as the throttle opens to the maximum degree of opening and become substantially zero in the high-output region, wherein the flow rate control mechanism comprises an on-off valve for opening/closing a low-speed fuel channel;

a driven member to which a valve element of the on-off valve is attached; and a cam coupled to a throttle valve stem, and wherein the driven member is in constant contact with the cam, and, with the on-off valve set to a certain degree of opening at the idle position of the throttle valve, the cam causes the valve element to linearly reciprocate so that the degree of opening of the on-off valve increases as the degree of opening of the throttle valve increases until the point in time at which the main fuel begins to flow, and thereafter causes the degree of opening of the on-off valve to decrease and become substantially completely closed at the completely open position of the throttle valve.

3. The carburetor according to claim 2, wherein the valve element is fixed to the driven member in an adjustable mounting position.

4. The carburetor according to claim 2, wherein the on-off valve comprises a valve element seated in a valve chamber formed in the low-speed fuel channel; the inlet to the valve chamber of the low-speed fuel channel is open to the peripheral lateral surface of the valve chamber; and the outlet from the valve chamber is open to the end face of the valve chamber in front of the valve element.

5. The carburetor according to claim 3, wherein the on-off valve comprises a valve element seated in a valve chamber formed in the low-speed fuel channel; the inlet to the valve chamber of the low-speed fuel channel is open to the peripheral lateral surface of the valve chamber; and the outlet from the valve chamber is open to the end face of the valve chamber in front of the valve element.

6. A carburetor comprising an air intake passage that passes through a main body of the carburetor, a main fuel system for delivering main fuel to a venturi area of the air intake passage, and a low-speed fuel system for delivering low-speed fuel to a throttle valve area of the air intake passage, the low-speed fuel system comprising a flow rate control mechanism linked to a throttle valve positioned in the air intake passage, the flow rate control mechanism increasing the low-speed fuel flow rate as the throttle valve opens from an idle position to a half open position and decreasing the low-speed fuel flow rate as the throttle valve opens from the half open position to a full open position, wherein the flow rate control mechanism includes a valve element for varying the opening of a low-speed fuel channel in the low-speed fuel system in response to the opening of the throttle valve, wherein the valve element increases the opening of the low-speed fuel channel as the throttle valve opens from the idle position to the half open position and decreases the low-speed fuel flow rate as the throttle valve opens from the half open position to a full open position.

7. The carburetor according to claim 6, wherein the flow rate control mechanism further comprises an on-off valve comprising the valve element for varying the opening of a low-speed fuel channel;

a driven member to which the valve element is attached; and a cam coupled to a throttle valve stem coupled to the throttle valve, the driven member is in constant operable contact with the cam, the cam causing the valve element to linearly reciprocate so that the degree of opening of the on-off valve increases and decreases in relation to the opening and closing of the throttle valve.

8. The carburetor according to claim 7, wherein the valve element is adjustably coupled to the driven member.

9. The carburetor according to claim 7, wherein the on-off valve comprises a valve element seated in a valve chamber formed in the low-speed fuel channel; the inlet to the valve chamber of the low-speed fuel channel is open to the peripheral lateral surface of the valve chamber; and the outlet from the valve chamber is open to the end face of the valve chamber in front of the valve element.

10. The carburetor according to claim 8, wherein the on-off valve comprises a valve element seated in a valve chamber formed in the low-speed fuel channel; the inlet to the valve chamber of the low-speed fuel channel is open to the peripheral lateral surface of the valve chamber; and the outlet from the valve chamber is open to the end face of the valve chamber in front of the valve element.

11. A carburetor comprising an air intake passage that passes through a main body of the carburetor, a main fuel channel extending from a fuel chamber to a venturi area of the air intake passage, a low-speed fuel channel extending from a fuel chamber to a throttle valve area of the air intake passage, and a flow rate control mechanism linked to a throttle valve positioned in the air intake passage and operably coupled to the low speed fuel channel, the flow rate control mechanism converting rotational movement of a throttle valve stem to reciprocal movement of a valve element, wherein the valve element travels in a first direction as the throttle valve opens from the idle position to a predetermined position, and thereafter travels in a second direction as the throttle continues to open to the maximum degree of opening.

12. The carburetor according to claim 11, wherein the flow rate control mechanism comprises an on-off valve including the valve element for varying the opening of the low-speed fuel channel;

a cam coupled to a throttle valve stem connected to the throttle valve, and a driven member to which the valve element is attached; the driven member in constant operable contact with the cam, the cam reciprocally driving the valve element to open and close the low speed fuel channel in relation to the opening and closing of the throttle valve.

13. The carburetor according to claim 12, wherein the valve element is adjustably coupled to the driven member.

14. The carburetor according to claim 13, wherein the on-off valve comprises the valve element seated in a valve chamber formed in the low-speed fuel channel; the inlet to the valve chamber of the low-speed fuel channel is open to the peripheral lateral surface of the valve chamber; and the outlet from the valve chamber is open to the end face of the valve chamber in front of the valve element.

15. The carburetor according to claim 12, wherein the on-off valve comprises the valve element seated in a valve chamber formed in the low-speed fuel channel; the inlet to the valve chamber of the low-speed fuel channel is open to the peripheral lateral surface of the valve chamber; and the outlet from the valve chamber is open to the end face of the valve chamber in front of the valve element.

* * * * *